US005130042A

United States Patent [19]

Kurachi et al.

[11] Patent Number: 5,130,042

[45] Date of Patent: * Jul. 14, 1992

[54] ELECTRORHEOLOGICAL FLUIDS COMPRISING CARBONACEOUS PARTICULATES DISPERSED IN ELECTRICAL INSULATING OILY MEDIUM HAVING P=N BONDS IN THE MOLECULE

[75] Inventors: Yasuo Kurachi, Tokyo; Mitsuya Tanaka, Kodaira; Yuichi Ishino, Fuchu; Tasuku Saito, Tokorozawa, all of Japan

[73] Assignee: Bridgestone Corporation, Tokyo, Japan

[ * ] Notice: The portion of the term of this patent subsequent to Feb. 11, 2009 has been disclaimed.

[21] Appl. No.: 603,007

[22] Filed: Oct. 25, 1990

[30] Foreign Application Priority Data

Oct. 25, 1989 [JP] Japan ..... 1-275926

[51] Int. Cl.[5] ..... C10M 169/04; C10M 125/02; C10M 105/74; C09K 3/00

[52] U.S. Cl. ..... 252/78.5; 252/73; 252/75; 252/572

[58] Field of Search ..... 252/574, 575, 572, 75, 252/78.5, 73

[56] References Cited

U.S. PATENT DOCUMENTS

| | | | |
|---|---|---|---|
| 2,876,247 | 3/1959 | Rätz et al. | 252/574 |
| 3,047,507 | 7/1962 | Winslow | 252/75 |
| 3,280,222 | 10/1966 | Kober et al. | 252/77 |
| 3,280,223 | 10/1966 | Kober et al. | 252/77 |
| 3,291,865 | 12/1966 | Kober et al. | 252/77 |
| 4,687,589 | 8/1987 | Block et al. | 252/572 |

FOREIGN PATENT DOCUMENTS

| | | |
|---|---|---|
| 203312 | 12/1986 | European Pat. Off. . |
| 361106 | 4/1990 | European Pat. Off. . |
| 372366 | 6/1990 | European Pat. Off. . |
| 374525 | 6/1990 | European Pat. Off. . |
| 64-6285 | 1/1989 | Japan . |

OTHER PUBLICATIONS

*Carbon*, International Committee for Characterization and Terminology Of Carbon "First Publication of Further 24 Tentative Definitions", 1983, vol. 21, No. 5, pp. 517–519.

*Carbon*, International Cooperation on Characterization and Nomenclature Of Carbon and Graphite, 1975, vol. 13, p. 251.

Matsepuro, "Structure Formation in an Electric Field and the Composition of Electrorheological Suspensions", translated from Elektroreol. Issled; Pril., Minsk, 1981.

*Primary Examiner*—A. Lionel Clingman
*Assistant Examiner*—Christine A. Skane
*Attorney, Agent, or Firm*—Cushman, Darby & Cushman

[57] ABSTRACT

Electrorheological fluids display swift and reversible increase in apparent viscosity under application of an electrical potential difference to the fluid, and are composed generally of electrical insulating oily medium and dielectric fine-particles dispersed therein.

It is an object of the present invention to provide an electrorheological fluid capable of exhibiting enhanced electrorheological effect with smaller electric power consumption.

Electrorheological fluid according to the present invention comprises particulates having a specific gravity of not smaller than 1.2 and water content of not larger than 4 wt. % dispersed in an electrical insulating oily medium havingf P=N bonds in the molecule.

1 Claim, No Drawings

ELECTRORHEOLOGICAL FLUIDS COMPRISING CARBONACEOUS PARTICULATES DISPERSED IN ELECTRICAL INSULATING OILY MEDIUM HAVING P=N BONDS IN THE MOLECULE

FIELD OF THE INVENTION

The present invention relates to electrorheological fluids, which are capable of changing remarkably and reversibly their viscoelastic property by means of regulating electrical potential difference applied thereto. The fluid is useful for electrical regulation of such mechanical apparatus as engine-mounts, shock absorbers, valves, actuators, clutches, etc.

DESCRIPTION OF THE PRIOR ART

The phenomenon of changing apparent viscosity of a fluid by application of an electrical potential difference is known as the Winslow's effect for many years. At the initial stage of development, the fluid was composed of starch or the like dispersed in a mineral oil or a lubricating oil. Though the fluid was able to show the importance of the electrorheological effect, but repeatability of the electrorheological effect was unsatisfactory.

For the purpose of obtaining fluids superior in the electrorheological property and repeatability, many proposals mainly concerned with particulates to be used as the dispersoid have been made. For example, highly hygroscopic resin particulates having acid groups like polyacrylic acid (Japanese Patent Provisional Publication Tokkai Sho 53-93186 [1978]), ion exchange resins (Japanese Patent Publication Tokko Sho 60-31211 [1985]), aluminosilicates (Japanese Patent Provisional Publication Tokkai Sho 62-95397 [1987]), etc. are known.

All of these electrorheological fluids are prepared by dispersing water-carrying hydrophilic particulates in an electrical insulating oily medium, and polarization of the particulates owing to the performance of water occurs when a high electrical potential difference is applied from the outside. The increase in viscosity is said to be caused by formation of bridging between particulates in the direction of the electrical field under the influence of the polarization.

In electrorheological fluids employing the water-carrying dispersoids for the purpose of inducing their electrorheological effects, however, there are such defects as an increase in electric power consumption especially at high temperatures due to increased electric current through the dispersoid particulates, restriction on usable temperatures so as to avoid evaporation or freezing of the water, and fluctuation of the composition and performance caused by the evaporation of water during a long period of usage.

Nonaqueous type electrorheological fluids substantially containing no water employing highly dielectric materials or semi-conductive particulates as the dispersoid have been proposed recently. For example, fluids employing organic semi-conductive particulates such as polyacenequinone (Japanese Patent Provisional Publication Tokkai Sho 61-216202 [1986]), and dielectric particulates prepared by forming a conductive thin film on the surface of organic solid particulate and then further forming thereon an electrical insulating thin film (Japanese Patent Provisional Publication Tokkai Sho 63-97694 [1988]) are proposed.

Studies are proceeding on the nonaqueous type electrorheological fluids, since they are expected to have possibilities of overcoming various conventional defects in water-carrying electrorheological fluids derived from the existence of water.

The present inventors have found as the result of their research based on this viewpoint that optically anisotropic carbon particulates can exhibit superior electrorheological effect in the nonaqueous type electrorheological fluid (Japanese Patent Application Sho 63-212615 [1988]).

As electrorheological properties vary depending on kinds of combinations between particulates and oily medium, there are proposals on combinations of them for exhibiting a more enhanced viscosity change when an electrical potential difference is applied thereto. For example, Japanese Patent Provisional Publication Tokkai Hei 1-198696 [1989]discloses a combination of polyfluoroalkylmethylsiloxane and polymethacrylic acid showing more improved electrorheological effect than that of heretofore known chlorinated paraffins employed in GB A No. 1570234. Further, U.S. Pat. Nos. 3047507 and 4645614 teach examples using silicone oils.

However, since most of these technologies have been developed concerning to aqueous-system electrorheological fluids using water-carrying particulates as the dispersoid, the influence of oily medium on electrorheological effect has not been explained clearly, and the electrorheological effect has not been satisfactory enough for practical application despite noticeable improvements in the effect shown by respective combinations, and there are occurrence of such problems as an increase of the electric current contrary to the improved electrorheological effect or an inferior dispersion due to the difference of specific gravities of oily medium and particulates in preferable combinations of them for achieving enhanced electrorheological effect.

Since silicone oils have dielectric constant of around 2, no sizable increase in the electric current occurs at room temperature even when they are employed for electrorheological fluids using water-carrying particulates as the dispersoid, so far as no excessive water is added thereto. However, their electrorheological effects are not so remarkable. Further, when particulates composed mainly of organic polymers such as highly hygroscopic resins having acid groups like polyacrylic acids (Japanese Patent Provisional Publication Tokkai Sho 53-93186 [1978]) are employed as the particulates, there still remains a durability problem. In case of inorganic particulates, when particulates having a specific gravity of greater than 1.2 like zeolite are used in consideration of durability, a means for suppressing the sedimentation is required.

As explained above, methods disclosed heretofore have various problems like the dispersion problem such as sedimentation of particulates, the durability problem or exhibition of electrorheological effect with an appropriate electric current from the view point of practical application.

SUMMARY OF THE INVENTION

It is an object of the present invention to provide an electrorheological fluid capable of exhibiting enhanced electrorheological effect with smaller electric power consumption.

Electrorheological fluid according to the present invention comprises particulates having a specific gravity of not smaller than 1.2 and water content of not larger than 4 wt.% dispersed in an electrical insulating oily medium having P=N bonds in the molecule.

DETAILED DESCRIPTION OF THE PREFERRED EMBODIMENTS

The present inventors have conducted profound studies on the relationship between the oils and particulates composing the fundamental component of electrorheological fluids to find out that remarkable electrorheological effect can be obtained by a proper selection of particulates with regard to water content and specific gravity of them and selection of oil to be combined with the particulates in the electrorheological fluid, and accomplished the present invention.

Electrorheological fluid according to the present invention comprises particulates having a specific gravity of not smaller than 1.2 and water content of not larger than 4 wt.% dispersed in an electrical insulating oily medium having P=N bonds in the molecule.

The fundamental knowledge deriving the accomplishment of the present invention may be summarized as follows:

(1) Generally, inorganic particulates have higher durability and larger specific gravity compared with organic particulates. Larger specific gravity causes the problem of sedimentation, so that it is necessary to employ particulates of smaller particle size or to employ an oily medium of larger specific gravity for the improvement.

(2) Employment of an oil of larger dielectric constant is preferable for enhancing the electrorheological effect. However, in the case of an aqueous-system electrorheological fluid, a large dielectric constant of oil tends to stimulate ionization of isolated water to result in increase of the electric current.

(3) In the case of nonaqueous type electrorheological fluids, increase of the electric amount is smaller in comparison with the enhancement of electrorheological effect regardless of a large dielectric constant of oil.

From the above three observation, it has become possible, by employing an electrical insulating oily medium having P=N bonds in the molecule and particulates employable for a nonaqueous type electrorheological fluid requiring no water for exhibiting the electrorheological effect such as those having a specific gravity of not smaller than 1.2 and water content of not larger than 4 wt.% and dispersing the particulates in the oily medium, to bring about so enhanced electrorheological effect without accompaniment of remarkable increase in the electric current as have never been available by any combination disclosed heretofore.

Other than the above observation, it has been noticed that the employment of the oily medium having P=N bonds in the molecule to aqueous-system electrorheological fluids is disadvantages compared with the employment of silicone oils or mineral oils because the electric current tends to flow easily due to its slightly lower electric resistance compared with silicone oils or mineral oils.

The present invention will be explained in detail hereunder.

Compounds having P=N in the molecule are called as phosphazene compounds, and three kinds of structures mentioned hereunder are known:

(1) A group of ring-structured compounds having more than 3 units of P=N bond in the molecule;

(2) A group of chain compounds having continuous and repeated P=N bonds in the molecule; and (3) A group of compounds structured in three-dimensional network by P=N bonds.

Compounds belonging to group (1) exemplified are; trimer, tetramer and n-pieces polymer having F atoms like $(PNF_2)_3$, $(PNF_2)_4$ and $(PNF_2)_n$ wherein [n<14]; trimer, tetramer and n-pieces polymer having Cl atoms like $(PNCl_2)_3$, $(PNCl_2)_4$ and $(PNCl_2)_n$ wherein [n<14]; trimer, tetramer and n-pieces polymer having Br atoms like $(PNBr_2)_3$, $(PNBr_2)_4$ and $(PNBr_2)_n$ wherein [n<14]; trimer, tetramer and n-pieces polymer having I atoms like $(PNI_2)_3$, $(PNI_2)_4$ and $(PNI_2)_n$ wherein [n<14]; or compounds having partly or entirely substituted organic groups for halogen atoms of the compounds mentioned above.

Such organic group substituted compounds can be obtained by substituting halogen atoms in the trimer, tetramer and n-pieces polymer compounds with nucleophilic reagents like $CF_3CH_2OHa$ and $C_6H_5OHa$. Notwithstanding any synthetic method employed, similar effect of the compound is attainable so far as the compound has more than 3 units of P=N bonds in the molecule and has ring structure.

Compounds belonging to group (2) exemplified are; chain compounds having P=N backbone structure and halogen atoms in the side chain like $(PNF_2)_n$ wherein [n<2], $(PNCl_2)_n$ wherein [n<2], $(PNBr_2)_n$ wherein [n<2] and $(PNI_2)_n$ wherein [n<2]; compounds having partly or entirely substituted organic groups for halogen atoms of the compounds having P=N backbone structure mentioned above and polymerized forms thereof.

Such organic group substituted chain compounds or polymers can be obtained by substituting halogen atoms in the halogen-containing compounds with nucleophilic reagents like $CF_3CH_2OHa$ and $C_6H_5ONa$. Notwithstanding any synthetic method employed, similar effect of the compound is attainable so far as the compound has a backbone structure of P=N bonds in the molecule.

Compounds belonging to group (3) are solid generally insoluble in various solvents being obtainable during synthesis of P=N containing compounds belonging to (1) or (2) or nitrogenated phosphorous compounds. They are mainly composed of P atoms and N atoms, and the remainder is a portion of elements included in the raw materials for the synthesis, though depending on their synthetic processes.

Among compounds belonging to (1), (2) and (3), those of (3) are frequently available in solid forms and are not suitable for the present invention.

Among compounds belonging to (1) and (2), those containing more than 1 wt.% of halogen atoms like F, Cl, Br and I bonded directly to P atom; those containing in the molecular structure more than 10 wt.% of ionizable atoms when they are added into water; those containing more than 10 wt.%, more strictly more than 1 wt.%, of compounds having atoms other than O, N and C bonding directly to P atoms in the —P=N— skeleton; and those having melting point of above 40° C.; are not suitable for the purpose of the present invention.

Accordingly, among phosphazene compounds belonging to the above mentioned groups (1), (2) and (3), those preferable for the present invention are compounds chemically stable, superior in electrical insulation and having melting point of below 40° C. selected from the groups (1) and (2). Examples of the compounds selected from the groups (1) and (2) are as mentioned hereunder, however, they merely are examples of molecular structures for oily medium and the oily medium used in the present invention are never limited by them.

Type 1: Compounds having O, N or C atoms bonded directly to P atoms of the —P=N— skeleton and having ring structure exemplified are;

$$(PNR_1R_2)_n[n<14]$$

$R_1$: aliphatic or aromatic side-chain group including alkoxy, amino, phenoxy and phenyl groups like $—OCH_2CF_3$, $—OCH_2CF_2CF_3$, $—N(CH_3)_2$, $—C_6H_5$, $—OC_6H_5$, $—NHC_6H_5$, etc.

$R_2$: aliphatic or aromatic side-chain group including alkoxy, amino, phenoxy and phenyl groups like $—OCH_2CF_3$, $—OCH_2CF_2CF_3$, $—N(CH_3)_2$, $—C_6H_5$, $—OC_6H_5$, $—NHC_6H_5$, etc., and groups like $—CH_2CH_3$ and $—NH_2$. It can be the same or different from $R_1$.

Other compounds included in Type 1 are those having entirely different or several kinds side-chain groups bonded to P atoms in the same molecule.

Among those compounds belonging to Type 1, such compounds as $(NP(NHC_6H_5)_2)_3$, $(NP(NHCH_2CHCH_2)_2)_3$, $(NP(OCH_2CF_3)_2)_3$, $(NP(OC_6H_5)_2)_3$, $(NP(OCH(CH_3)_2)_2)_3$, etc. have high melting point or poor durability. Accordingly, employment of them as a main oily medium is not preferred, but the employment of less than 30 wt.%, preferably less than 10 wt.%, of them in the oily medium may be allowed so far as oil properties are not deteriorated.

Type 2: Compounds having O, N or C atoms bonded directly to P atoms of the —P=N— skeleton and having chain structure exemplified are;

$$(PNR_1R_2)_n[n<2]$$

$R_1$: aliphatic or aromatic side-chain group including alkoxy, amino, phenoxy and phenyl groups like $—OCH_2CF_3$, $—OCH_2CF_2CF_3$, $—N(CH_3)_2$, $—C_6H_5$, $—OC_6H_5$, $—NHC_6H_5$, etc.

$R_2$: aliphatic or aromatic side-chain group including alkoxy, amino, phenoxy and phenyl groups like $—OCH_2CF_3$, $—OCH_2CF_2CF_3$, $—N(CH_3)_2$, $—C_6H_5$, $—OC_6H_5$, $—NHC_6H_5$, etc., and groups like $—CH_2CH_3$and $—NH_2$. It can be the same or different from $R_1$.

Other compounds included in Type 2 are those having entirely different or several kinds side-chain groups bonded to P atoms in the same molecule.

Among compounds belong to Type 2, compounds having two aliphatic side-chains containing no halogen bonded to the same P atom such as $(NP(NHCH_2CHCH_2)_2)_n$ and $(NP(OCH(CH_3)_2)_2)_n$ are poor in durability and not preferred. Further, those having molecular weight of more than several ten thousands are difficultly turned to oily and are not preferred.

Phosphazene compounds usable for the present invention are limited to those belonging to the above-mentioned Type 1 or Type 2, or mixtures of more than two kinds selected from Type 1 and Type 2.

Particulates usable for the present invention are those employable for usual nonaqueous type electrorheological fluids, which have specific gravity of larger than 1.2 and water content of less than 4 wt.%.

Particulates having specific gravity of less than 1.2 like glass balloon are not preferred due to difficulty in dispersing them uniformly into the oily medium, when they are combined with phoxphazene oils mentioned above.

The upper limit of the specific gravity is preferably 8.0. When the specific gravity is larger than 8.0, sedimentation of the particulates increases.

The water content referred herein is the content of water which can be evaporated from the surface of particulates at temperatures between 100° C. and 150° C., and such kinds of water stable above 150° C. like constitution water of clay minerals including montmorillonite and kaolinite, or crystal water are not included in the water content.

That is, the water content referred in the present invention is a content of water physically adsorbed on the surface of particulates, and is measurable with the Karl-Fisher's method or with an infrared moisture meter.

The water content depends partly on particle size of particulates, and a larger water content can be occurred even for particulates having the same chemical structure when the particle size becomes smaller, since adsorbing capacity of water increases in accordance with increased surface are. Particulate showing water content of larger then 4 wt.% without a specific addition of water are sometimes those containing a great deal of particulates smaller than 1 μm size or those having high dimensional structure of particulates. When a phosphazene oil and particulates containing more than 4 wt.% water are mixed to obtain and electrorheological fluid and an electrical potential difference is applied thereto, water of these kinds tends to increase the electric current, and so is not preferred.

As to particulates having a specific gravity of not smaller than 1.2 and water content of not larger than 4 wt.% being usable for the present invention, they are exemplified by powder of non-oxides like carbonaceous powder, SiC powder, TiC powder and $B_4C$ powder, and powder of oxides like zeolite, amorphous silica, slightly surface oxidized Al powder, barium titanate and clay minerals.

Among powder mentioned above, zeolite is represented by the formula $M_{(x/n)}[(AlO_2)_x(SiO_2)_y]_wH_2O$ (M is a metallic cation or a mixture of metallic cations having n electrons in average; x and y each is an integer; ratio of y to x is around 1–5, and w is indefinite), and contains sometimes more than 4 wt.% of water originated from the synthetic step of powder.

For aqueous system electrorheological fluids, these hygroscopic particulates are preferably employed due to the attainability of remarkable electrorheological effect, however, for the present invention, these particulates are employed after removing the water by vacuum drying. Particulates other than zeolite containing a large amount of adsorbed water are employable for the present invention, if the water can be removed by vacuum drying. In the present invention, the water is removed to a level of smaller than 4 wt.%, preferably smaller than 2 wt.%, more preferably smaller than 1 wt.%, and the particulates are mixed with a phosphazene oil for the preparation of electrorheological fluids.

Carbonaceous particulates suitable as the dispersoids of electrorheological fluids according to the present invention are explained in detail further.

Carbon content of the carbonaceous particulates is preferably 80–97 wt.%, more preferably 90–95 wt.% and atomic ratio of carbon to hydrogen (C/H ratio) of the carbonaceous particulates is preferably 1.2–5, more preferably 2–4.

The carbonaceous particulates having the above C/H ratio are exemplified concretely by finely pulverized coal-tar pitch, petroleum pitch and pitch from thermal decomposition of polyvinyl chloride; particulates composed of various mesosphases obtained by heat-treatment of these pitch or tar components like particulates obtained from optically anisotropic spherelets (sperulite or mesophase spherelet) by removing pitch components with dissolution in solvents; further pulverized products of these particulates; pulverized bulk mesophase obtained by heat. treatment of raw material pitch (Japanese Patent Provisional Publication Tokkai Sho 59-30887 [1984]); pulverized partly crystallized pitch; particulates of so-called low temperature treated carbon like low temperature carbonized thermosetting resins including phenolic resins. Examples are further mentioned of pulverized coal including anthracite and bituminous coal or their heat-treated products; carbonaceous spherelets obtained by heat-treating under pressure mixtures of vinyl-type hydrocarbon polymers like polyethylene, polypropylene or polystyrene and chlorine-containing polymers like polyvinylchloride or ployvinylidenechloride; and carbonaceous spherelets obtained by pulverization thereof.

Average particle size desirable as the dispersoid is 0.01-100 microns, preferably 0.1.20 microns, and more preferably 0.5-5, microns. When it is smaller than 0.01 micron, the initial viscosity under no application of electrical potential difference becomes too large to cause small viscosity change by the electrorheological effect, and particle size larger than 100 microns causes insufficient stability of the dispersoid in liquid phase.

Ratios of the dispersoid to liquid phase constituting electrorheological fluids of the present invention are 1.60 wt.%, preferably 10-50 wt.% of the dispersoid content, and 99-40 wt.%, preferably 90-50 wt.% of the content of liquid phase composed of the electrical insulating oily medium mentioned above. When the dispersoid content is less than 1 wt.%, the electrorheological effect is small, and the initial viscosity under no application of electrical potential difference becomes extremely large when the content is greater than 60 wt.%.

Embodiments and effects of the present invention will be explained concretely hereinafter with an example, however, the present invention never be limited by the example.

EXAMPLE 1

Carbonaceous particulates having an average particle size of 3 microns; carbon content of 93.78 wt.%; C/H ratio of 2.35; water content of 0.2 wt.% and specific gravity of 1.4 were prepared by heat-treating mesophase carbon from coal-tar pitch under nitrogen gas stream. An electrorheological fluid was prepared by dispersing 10 grams of the particulates into 34 grams of a phosphazene oil ($P_3N_3(OCH_2CF_2CF_2CF_2CF_2H)_n(OCH_2CF_2CF_3)_{6-n}$; mixture of n = 1-6). The electrorheological effect was measured by using a double cylinder type rotary viscometer, with which viscosities under shearing speed of 366 $sec^{-1}$ at 25° C. were measured when an electrical potential difference of 0 or 2 KV/mm was applied between outer and inner cylinders.

Viscosities were 5.8 P (poise) and 37.4 P without and under application of 2 KV/mm electrical potential difference respectively, showing a viscosity difference of 31.6 P. The electric current under the 2 KV/mm application was 0.385 mA.

COMPARATIVE EXAMPLE 1

An electrorheological fluid was prepared by dispersing 10 grams of the same carbonaceous particulates with that of Example 1 into 19 grams of a silicone oil (a mixture of TSF451-10 and TSF451-500; Produce of Toshiba Silicone Co. respectively). The fluid was subjected to measurement of electrorheological effect with the similar method to Example 1, and obtained viscosities of 5.9 P and 13.4 P without and under application of the 2 KV/mm application respectively, showing a viscosity difference of 7.5 P. The electric current under the 2 KV/mm application was 0.39mA.

EXAMPLE 2

An electrorheological fluid was prepared by dispersing 10 grams of SiC particulates having an average particle size of 5 microns; water content of 0.28 wt.% and specific gravity of 3.2 into 34 grams of the same phosphazene oil as used in Example 1. The fluid was subjected to measurement of electrorheological effect with the similar method to Example 1, and obtained viscosities of 7.2 P and 13.2 P without and under application of the 2 KV/mm application respectively, showing a viscosity difference of 6.0 P. The electric current under the 2 KV/mm application was 0.35 mA.

COMPARATIVE EXAMPLE 2

An electrorheological fluid was prepared by dispersing 10 grams of the same SiC particulates with that of Example 2 into 19 grams of a silicone oil (a mixture of TSF451-10 and TSF451-500; Produce of Toshiba Silicone Co. respectively). The fluid was subjected to measurement of electrorheological effect with the similar method to Example 1, and obtained viscosities of 6.3 P and 6.4 P without and under application of the 2 KV/mm application respectively, showing a viscosity difference of 0.1 P. The electric current under the 2 KV/mm application could not measured because of an excessive current flow.

The above results are shown in Table 1.

TABLE 1

| | particulates | Oil | ER effect |
|---|---|---|---|
| Example 1 | Carbonaceous | phosphazene oil | 31.6 P |
| Comparative Example 1 | Carbonaceous | silicone oil | 7.5 P |
| Example 2 | SiC | phosphazene oil | 6.0 P |
| Comparative Example 2 | SiC | silicone oil | 0.1 P |

It is clear from the results that electrorheological fluids employing the phosphazene oil exhibit higher electrorheological effect.

We claim:

1. An electrorheological fluid comprising 1-60 wt.% of carbonaceous particulates dispersed in 99-40 wt.% of an electrical insulating oily medium, wherein;

a) said carbonaceous particulates having a carbon content of 80-97 wt.%, C/H ratio (atomic ratio of carbon/hydrogen) of 1.2-5, a specific gravity of not smaller than 1.2, water content of not larger than 4 wt.% and oxygen atom content of not more than 10 wt.%; and;

b) said oily medium is a ring-structured compound having in the molecule more than 3 units of P=N bond and O, N or C atoms bonded directly to P atoms of the —P=N— skeleton, or a chain compound having in the molecule continuous and repeated P=N bonds and O, N or C atoms bonded directly to P atoms of the —P=N— skeleton.

* * * * *